US005742956A

United States Patent [19]

Tarver

[11] Patent Number: 5,742,956

[45] Date of Patent: Apr. 28, 1998

[54] MODULAR BATHROOM UNIT

[76] Inventor: Alan Tarver, 84636 Hwy. 25 P.O. Box 431, Folsom, La. 70437

[21] Appl. No.: 769,139

[22] Filed: Dec. 18, 1996

[51] Int. Cl.[6] ..... A47K 4/00

[52] U.S. Cl. ..... 4/663; 4/664; 4/644

[58] Field of Search ..... 4/663, 664, 665, 4/643, 644, 650

[56] References Cited

U.S. PATENT DOCUMENTS

| | | | |
|---|---|---|---|
| 1,480,145 | 1/1924 | Berven | 4/644 |
| 1,560,386 | 11/1925 | Langston | 4/644 |
| 2,907,048 | 10/1959 | Gould | 4/663 |
| 3,100,907 | 8/1963 | King . | |
| 3,533,200 | 10/1970 | Zoebelein . | |
| 4,133,057 | 1/1979 | Rivetti . | |
| 4,653,128 | 3/1987 | Canalizo . | |
| 5,111,626 | 5/1992 | Fortune . | |
| 5,261,127 | 11/1993 | Tsipov . | |
| 5,335,378 | 8/1994 | Chiang . | |

*Primary Examiner*—David J. Walczak
*Attorney, Agent, or Firm*—Joseph T. Regard, LTD.

[57] ABSTRACT

A modular bathroom unit configured for comfort and spaciousness, with a relatively small footprint. The preferred embodiment of the present invention includes a commode, shower with floor drain, and a relatively large lavatory, which is configured to pivot to a vertical position for space savings when not in use, or to a horizontal position for use. Further contemplated is a unique drain connection system, wherein the lavatory drain includes a drainpipe connection to a stationary drainpipe built into the wall structure of the unit, the connection accomplished without the requirement of hoses, pipe fittings or the like. The present invention provides a shower and toilet facility which may be utilized with no impositions or restrictions on the user, while the interior is configured to be watertight, with a sealed door, and an easily cleaned interior surface. The preferred embodiment of the present invention is fabricated as a one-piece, molded fiberglass unit, although other methods of manufacture may also be employed, with satisfactory results. The present system may be utilized as a stand alone, portable bathroom facility, or may be implemented in the form of a space saving bathroom, in a building or other structure, or in a camper, boat, or modular housing or the like, or any other location where a small, yet full-featured bathroom is desired.

13 Claims, 5 Drawing Sheets

FIG. 2b
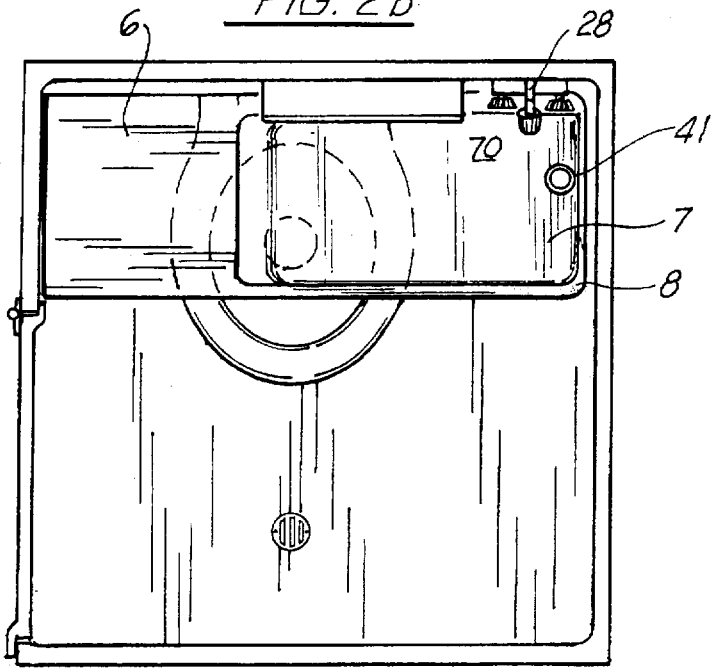
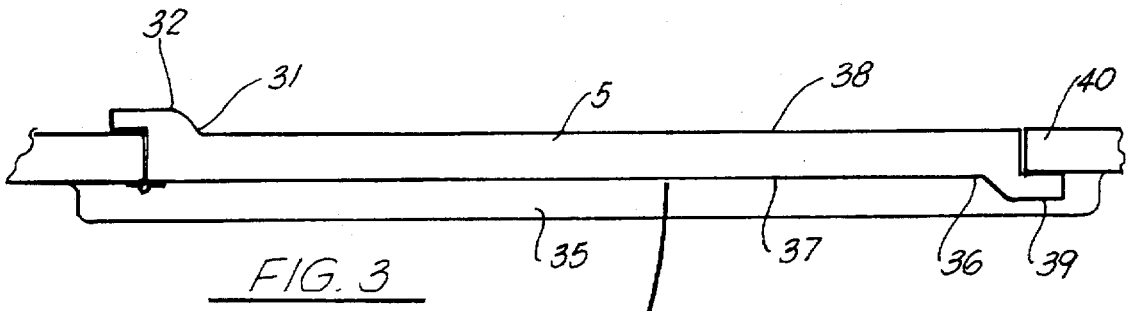
FIG. 3
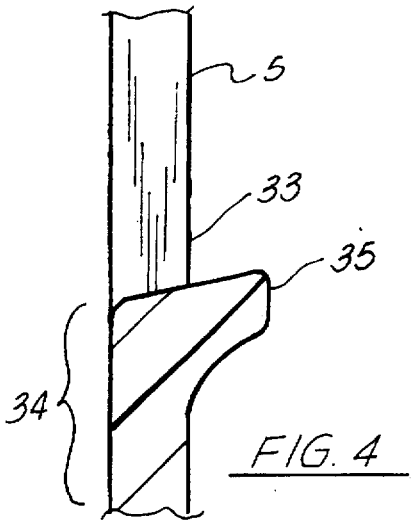
FIG. 4
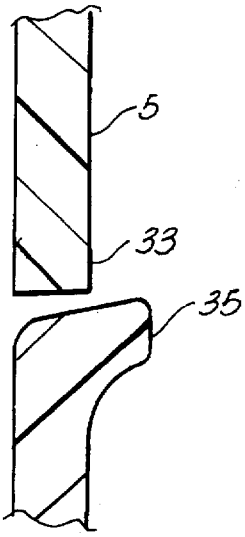
FIG. 5

MODULAR BATHROOM UNIT

TECHNICAL FIELD OF THE INVENTION

The present invention relates to portable, space saving living units, and in particular to a modular bathroom unit configured for comfort and spaciousness, with a relatively small footprint. The preferred embodiment of the present invention includes a commode, shower with floor drain, and a relatively large lavatory, which is configured to pivot to a vertical position for space savings when not in use, or to a horizontal position for use.

Further contemplated is a unique drain connection system, wherein the lavatory drain includes a drainpipe connection to a stationary drainpipe built into the wall structure of the unit, the connection accomplished without the requirement of hoses, pipe fittings or the like.

The present invention provides a shower and toilet facility which may be utilized with no impositions or restrictions on the user, while the interior is configured to be watertight, with a sealed door, and an easily cleaned interior surface.

The preferred embodiment of the present invention is fabricated as a one-piece, molded fiberglass unit, although other methods of manufacture may also be employed, with satisfactory results.

The present system may be utilized as a stand alone, portable bathroom facility, or may be implemented in the form of a space saving bathroom, in a building or other structure, or in a camper, boat, or modular housing or the like, or any other location where a small, yet full-featured bathroom is desired.

BACKGROUND OF THE INVENTION

While the prior art has contemplated numerous and diverse space-saving living quarters, kitchens, bathrooms, and the like, none are believed to teach, contemplate, or otherwise suggest the present invention.

Patents which might be considered at least pertinent with regard to the present invention include:

| Patent Number | Inventor | Date of Issue |
|---|---|---|
| 5261127 | Tsipov | 11/16/1993 |
| 5111626 | Fortune | 05/12/1992 |
| 4653128 | Canalizo | 03/31/1987 |
| 4133057 | Rivetti | 01/09/1979 |
| 3533200 | Zoebelein | 10/13/1970 |
| D251,604 | Clow | 04/17/1979 |
| D203,253 | Kanter | 12/21/1965 |

U.S. Pat. No. 4,133,057, issued 1979 teaches a "Toilet Set to be Installed in a Medium Sized Room", wherein there is provided a combination commode, tilting sink/shower unit, all provided in a nominal area, which functions as a shower stall.

U.S. No. Pat. 4,653,128 issued 1987 contemplates a "Modular Bathroom Unit" teaching a shared plumbing and cabinets.

Pat. Des No. 251,604 teaches a "Combined Shower Stall and Floor Toilet". U.S. Pat. No. 5,261,127, issued in 1993, teaches a shower stall having a pivoting sink, which is configured to store in a vertical configuration, providing space for utilization of the stall. U.S. Pat. Des No. 203,253 teaches a "Prefabricated Bath Facility", wherein there is provided a sink, commode, and shower stall in a single, unitary structure.

U.S. Pat. No. 3,533,200 contemplates a "Prefabricated Room Assembly", which may be in the form of a stack able, modular bathroom.

Lastly, U.S. Pat. No. 5,111,626, issued 1992, teaches a "Self-Contained Modular Unit", which contains a shower, toilet, lavatory, and sleeping facilities.

Thus, while the known prior art has contemplated several, diverse modular housing configurations and embodiments, none appear to have contemplated the unique combination of flexible application with space-saving characteristics, as has been taught and claimed in the present invention.

GENERAL SUMMARY DISCUSSION OF THE INVENTION

Unlike the prior art, the preferred embodiment of the present invention provides a comfortable, versatile, sanitary, easy to implement and use, and cost effective modular bathroom unit.

The preferred embodiment of the present invention comprises a modular bathroom system configured to provide all of the features of a full-sized bathroom, but in the space of a small closet. The present system may be a one-piece, fiberglass molded unit or the like, and may be installed in a vehicle, such as a commercial freight truck or camper, or may be provided as a modular, portable, stand-alone bathroom for outdoor or indoor use, or may be simply a prefabricated bathroom module for placement in condominiums, warehouses, or any other diverse location where a small, yet full-featured bathroom is desired.

The preferred embodiment of the present invention comprises a shower stall unit having therein a commode, sink, and mirror, all arranged so as to provide convenient, unhindered use of each of the features, as desired. The lavatory unit is hinged along one end to the wall, so as to allow lifting of same for storage against the wall, to provide for use of the commode or shower.

A built-in roll paper holder is provided in the lavatory unit for facilitating ease of dispensing, while providing a dry, compartmented storage area, enclosing the paper sufficiently for preventing contact with water during showering, utilization of the lavatory, or like activity.

The preferred embodiment of the present invention further teaches a unique drain connection system, wherein the lavatory drain includes a connect able drainpipe connection to a stationary drainpipe built into the wall structure of the unit, the connection dis-disconnecting upon the lifting of the sink for storage against the wall for showering, utilizing the commode, or other activity, and automatically reconnecting in a watertight, reliable seal upon the placement of the lavatory in the horizontal use position, the connection accomplished without the requirement of hoses, pipe fittings or the like.

The invention further contemplates a modular living compartment, which may include the modular bathroom of the present invention, the exemplary embodiment of the living compartment configured to provide about an 8'×8' footprint, making it especially useful for utilization as a living quarters mounted to the cab of a tractor-trailer system.

The modular living compartment includes a bathroom as contemplated above, a kitchen unit with refrigerator and stove or microwave, a dining/living area convertible to a sleeping compartment, and other conveniences commonly available in one's home.

The modular living compartment further includes a unique rollbar/conduit system for providing protected water and electrical about the compartment, wherein the rollbar encases major electrical and water conduits.

The living compartment may include an electrical generator, heater, water supply, air conditioning, television, ventilation, and storage.

The living compartment may also include a first entryway, which, when affixed to a tractor trailer, could provide direct access into the cab of the vehicle, as well as a second entryway, which may be in the form of an emergency exit.

It is therefore an object of the present invention to provide a modular bathroom system which is relatively comfortable, durable, sanitary, and easily maintained and implemented.

It is another object of the present invention to provide a modular bathroom system which provides a commode, lavatory, and shower in a relatively small footprint, yet providing a spacious accommodation to the user.

It is another object of the present invention to provide a tilting lavatory wherein there is provided a drain conduit quick dis-connect/re-connect, providing an automatic, secure, odor-free drain connection, which is automatically implemented upon lowering of the lavatory to the horizontal use position, and disengaged upon lifting of the lavatory to the storage/non-use position.

It is another object of the present invention to provide a modular living system which may be secured to a tractor trailer, providing living, sleeping, and bathroom facilities.

It is still another object of the present invention to provide a modular bathroom facility which includes a lavatory facility which provides a full-sized bathroom sink when needed, yet is storable in an upright position, providing access to shower and toilet facilities.

It is another object of the present invention to provide a unique rollbar/conduit system for providing protected water and electrical about a modular living compartment, wherein the rollbar encases major electrical and water conduits.

It is another object of the present invention to provide a hinged lavatory unit including a built-in roll paper holder for facilitating ease of dispensing, while providing a dry, compartmented storage area, enclosing the paper sufficiently for preventing contact with water.

Lastly, it is an object of the present invention to provide a modular living system which can accommodate three or more people, providing sleeping, living, kitchen and toilet facilities, in a footprint area of, for example, 8'×8'.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein:

FIG. 2*b* is a top, cut-away view of the invention of FIG. 1, illustrating the placement of the lavatory unit in its use position relative to the commode and shower drain.

FIG. 3 is a top view of the door of the invention of FIG. 1, illustrating the side edge door seals for preventing the leakage of water therethrough.

FIG. 4 is a side, cross-sectional view of the door of the invention of FIG. 3, illustrating the bottom door seal for preventing the leakage of water therethrough.

FIG. 5 is a side, cross-sectional view of the door of the invention of FIG. 4, illustrating the door in a slightly open position, and the relationship of the door seal thereto.

DETAILED DESCRIPTION OF THE INVENTION

Figure 1:
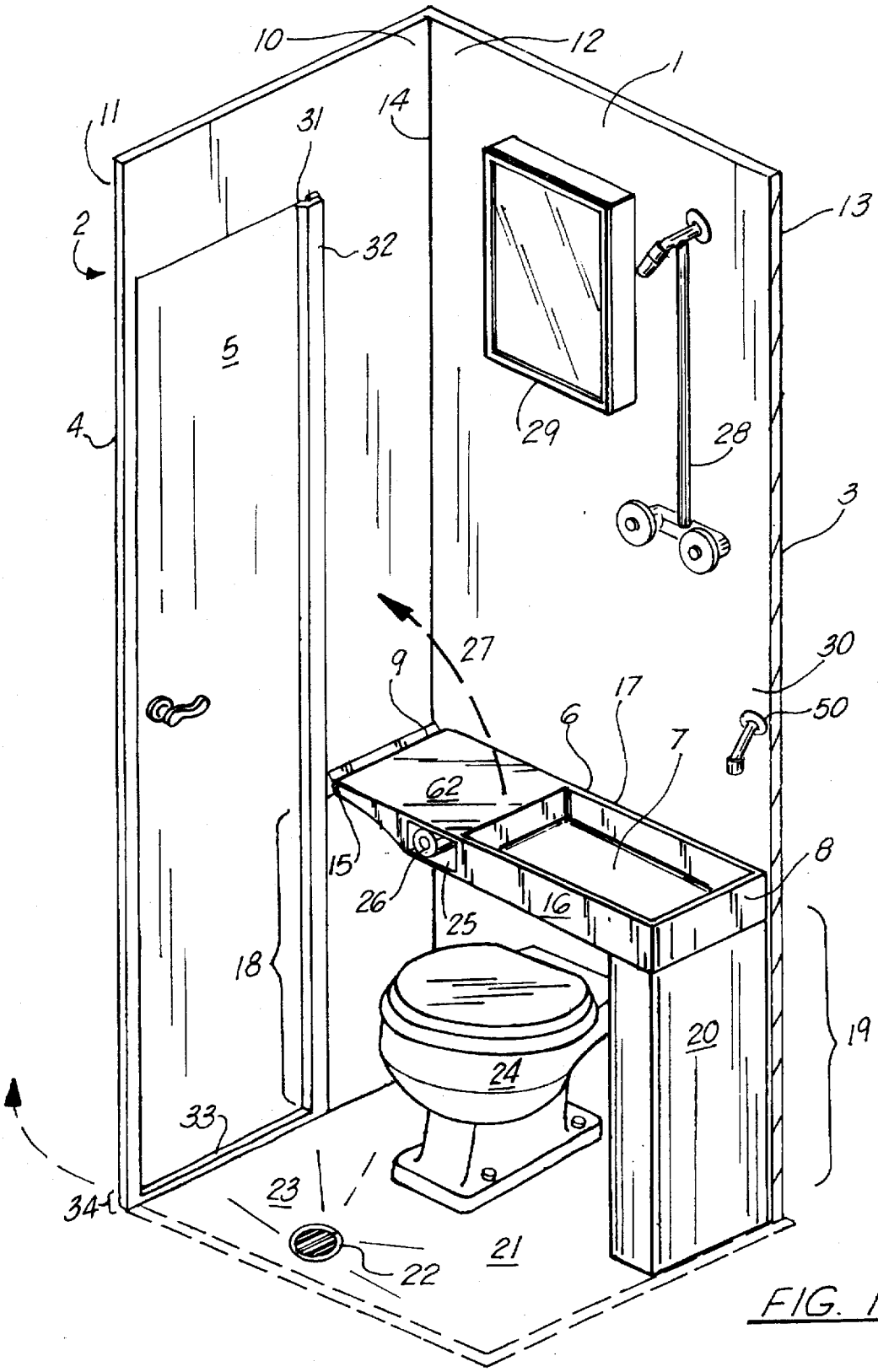
FIG. 1 is an isometric, partially cut-away view of the preferred embodiment of the modular bathroom system of the present invention, illustrating various components of the invention.

Referring to FIG. 1 of the drawings, the bathroom unit 1 of the modular bathroom system 2 of the present invention includes first 3 and second 4 walls, each said wall having first 10, 12 and second 11, 13 edges, respectively, said first and second walls joined at said first edges to form a corner 14.

In the present exemplary embodiment of the invention, a door 5 is formed in the second wall 4, although said door could be as easily formed in other walls with like results. As shown, the door includes a door knob, or other latch means for retaining the door in a closed position.

Continuing with FIG. 1, a lavatory unit 6 is shown, having a sink 7 disposed therein, the lavatory unit having first 8 and second 9 ends, the second end 9 pivotally joined to the second wall 4 via hinge member 15, while the first end 8 rests upon drain box 20.

The lavatory unit 6 has front 16 and rear 17 edges, the rear 17 edge juxtaposed first wall 3, the front 16 edge in an open area, the front edge further having formed therein, between the sink 7 and second end 9, a paper compartment 25, configured to hold and dispense a roll of toilet paper 26 therein. A flat table surface 62 may be provided adjacent to the sink 7, for placement of toiletries, etc. during use.

The hinge 15 supporting the second end 9 of lavatory unit 6 is spaced 18 above the floor 21 so as to provide comfortable use to a standing user, and is spaced to retain the second end 9 of the lavatory unit 6 at a height about equal to the top of the drain box 20.

As shown, the hinge connection of lavatory unit allows the lavatory to be lifted 27 by the second end 9, pivoting the unit from a horizontal, use position, to a vertical, storage position. More features of the lavatory unit will be discussed infra.

Continuing with FIG. 1, the floor 21 has formed to slope 23 to a drain 22, positioned for draining shower water, as well as cleaning the unit.

Situated generally adjacent to the first wall 3 is a commode 24, which can comprise a recreational vehicle-type toilet, or a standard toilet, configured to provide a relatively low profile, under the lavatory unit 6, and is positioned to provide unencumbered use with the lavatory in the vertical storage position.

Also shown is a shower unit 28, which may be positioned on the first 3 wall, or another wall with equally satisfactory results, and a lavatory water faucet 50, which may have hot and cold water controls, and should be positioned upon the wall, outside of the swing arc of the lavatory unit so as not to incumber pivotal movement thereof. In the alternative, the faucet 50 may be built into the lavatory unit, and connected to the water supply by flexible hose or the like, or the shower unit 28 may be on a hose, to allow use as a faucet for the sink and sprayer for washing dishes and the like. Further, the water faucet 50 may be able to pivot to swing out of the way, and may be controlled by the shower water control knobs, with a selector switch for shower or faucet.

Also situated above the lavatory unit in the present, exemplary embodiment of the invention, is a mirror 29, which may also contain a medicine cabinet.

Situated along the inside edge 31 of the door 5 is a splash guard 32, configured to keep water spray within the room, especially when the shower is in operation. The bottom edge 33 of the door is situated above the floor 21, via spacer 34, to prevent water leakage therethrough.

Further, as shown in FIG. 4, the bottom 33 of door 5 interfaces a lip 35 to further seal the door to prevent liquid therethrough, allowing for unhindered opening, as shown in FIG. 5, when desired.

Referring to FIG. 3, the door 5 includes an outside edge 36, and inside edge 31, an outside 37, and an inside 38. Provided along the outside edge of the door, emanating from the outside 38 is a second splash guard 39, preventing the migration of water between the door 5 and wall 40, and working in conjunction with splash guard 32, situated along the opposing edge, along the inside of the door, to prevent the passage of water therethrough.

Referring now to FIG. 2B, formed generally adjacent to the first end 8 of the lavatory unit 6 of the exemplary embodiment of the present invention a drain 41, with the sink 7 sloping 70 towards said drain 41. As shown, the shower 28 could, as an alternative embodiment of the present invention, function as a faucet for the sink, either as a fixed unit, or via hose connection.

Figure 2A:
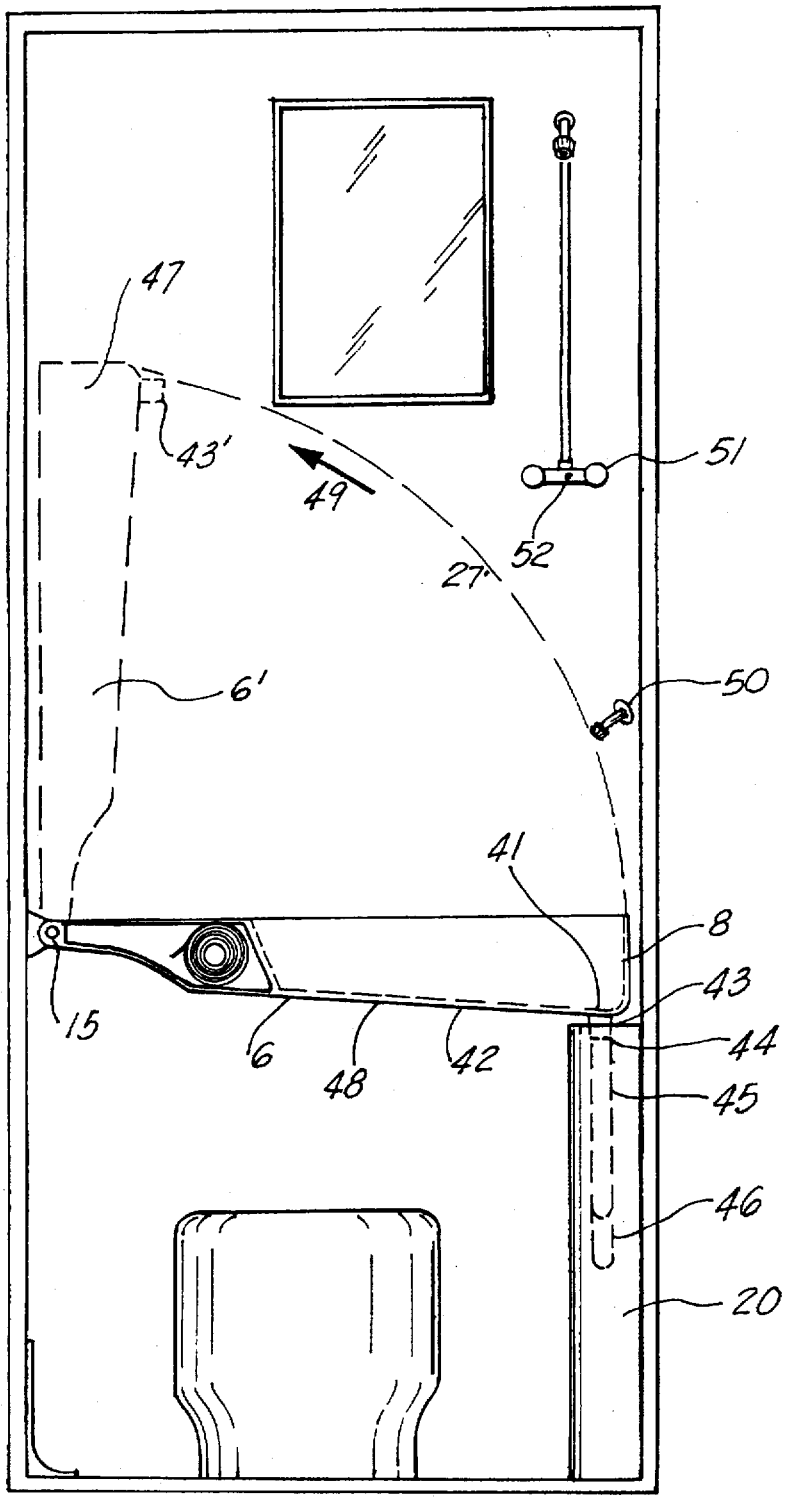
FIG. 2*a* is a frontal, cut-away view of the invention of FIG. 1, illustrating the movement of the lavatory unit from the horizontal, use position to the vertical, storage position, with the drain conduit shown in phantom.

As shown in FIG. 2A, emanating with the underside 42 of the sink 6 from the drain 41 is a male drain piece configured to communicate with a female drain coupling 44 originating a drain conduit 45 formed in the drain box 20, the coupling of the male drain piece with the female drain coupling taking place when in the lavatory unit 6 is in the horizontal use position 48. The drain conduit 45 may include, as shown, a pea trap 46 for preventing the emission of fumes from the dirty water, which may be piped to sewerage, or may be tanked in a storage tank under the present unit.

As further illustrated in FIG. 2A, the lavatory 6, may be raised 49, as earlier discussed, so as to pivot the hinge 15, raising the first end of the lavatory unit 6' (in phantom) to a vertical storage position 47. To retain the lavatory unit in the vertical, storage position, the hinge may be configured to provide resistance, or there may be provided a latch, strap, or any number of other retaining means already known and used in the art.

The arc 27' or the pivot motion of the lavatory unit is illustrated in phantom, so as so indicate the appropriate positioning of, for example, the faucet 50, so as not to block the raising or of the lavatory unit. As earlier indicated, the faucet can be made to rotate so as to be adjustable outside of the arc of the pivot motion of the lavatory unit, as desired. As earlier indicated, the valves 52 controlling the shower head might also, if desired, be switchable via switch 52 to control the faucet, as desired, or the faucet might have its own controls.

In the preferred embodiment of the present invention, the modular bathroom system of the present invention is a fiberglass structure fashioned from a mold utilizing conventional fiberglass fabrication methods. An example of the present invention would have an inside floor to ceiling height of about, for example, 6'8", and the outer shell would have a measure of about, for example, 78" H×44" W×5" D.

Preferably, the present system would also include a heater/vent unit in the ceiling, with exhaust to the outside, and may include a sun dome which could be opened, for providing light and ventilation in situations where electricity would be unavailable.

The commode unit could comprise a stand-alone, chemical toilet, which would not require a water source or separate septic tank, or it could comprise a conventional toilet unit, with a conventional floor toilet hookup and seal, with either septic hookups exterior the unit, or a septic tank built under the floor. Likewise, a grey water tank or outside drain hookups may be provided, as desired, for the drain water from the lavatory or floor/shower drain.

Similarly, an exterior water supply hookup may be provided, and/or a water tank may be build into the floor of the unit, as desired; such designs already exist in the art, and are commonly found in boats, recreational vehicles, campers, and the like.

Figure 6:
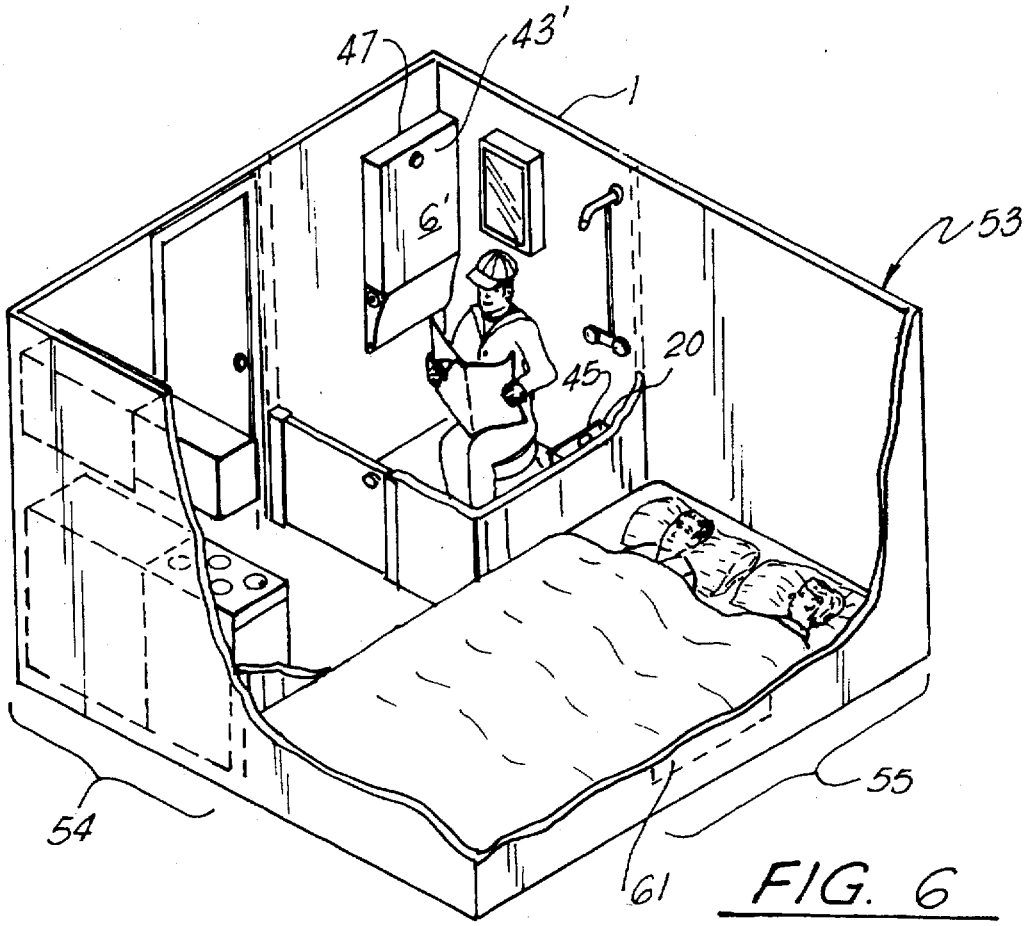
FIG. 6 is an isometric, partially cut-away view illustrating the layout of an exemplary living unit which includes the modular bathroom unit of the present invention, particularly configured for placement behind the cab of a tractor/trailer vehicle.
Figure 8:
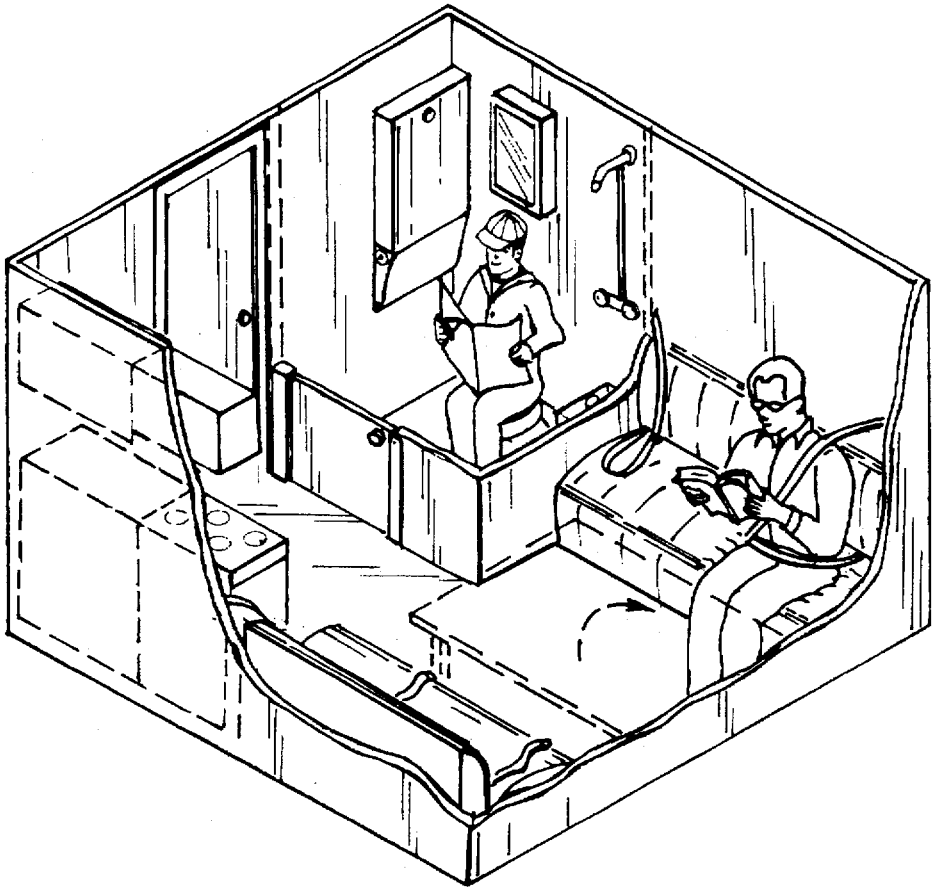
FIG. 8 is an isometric, partially cut-away view illustrating the invention of FIG. 6, illustrating the living area converted from the bedding configuration to the dining configuration, with the table in phantom, and seat belts along the bench seats.

FIG. 6 illustrates an alternative embodiment of the present invention, comprising a living modular living unit 53 including the bathroom unit 1 of the present invention. As shown, the sink 6' is shown in its upright, vertical storage position 47, exposing the male drain piece 43', which is configured to interface with the drain conduit 45 of the drain box 20, as earlier discussed.

As further shown, the modular living area is configured to provide a small footprint, for example, 8'×8', such that it might be placed upon, for example, behind a tractor-trailer cab., the modular living unit further providing a kitchen area 54, and a a bunk/dining/living area 55, the system configured to provide a comfortable, sanitary, relatively roomy, and versatile living system, when compared to other prior art systems.

An emergency escape panel or door 61 may be provided to allow for occupants an alternative exit in the event of fire, assault, or other emergency situation.

Figure 7:
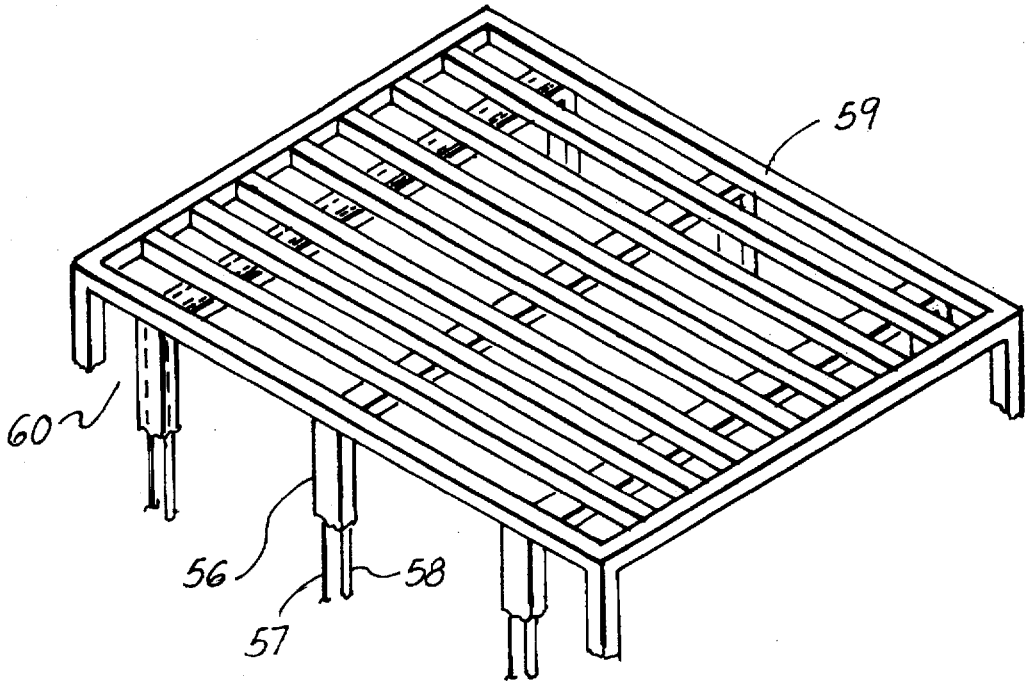
FIG. 7 is an isometric view of an exemplary rollbar configuration, which rollbar is configured to further provide a conduit for the passage of electrical and water pipes therethrough.

Referring to FIG. 7, the present invention may have built into its side walls 60 and ceiling 59 a rollbar 56 or steel conduit or the like, rectilinear or cylindrical, the rollbar configured to encase electrical 57 and water conduits 58, providing enhanced protection and structural integrity for the modular building unit, as well as increased protection for the electrical and water from outside interference. While FIG. 7 illustrates an aluminum channel construction, this is by no means required of the present embodiment, and the rollbar/conduit arrangement can be utilized with most any construction, including fiberglass, forming a single, unitary structure, or foam core, etc.

In the preferred embodiment of the invention of the modular living system, the floor, side walls 60 and ceiling 59 may be fabricated of, for example, foam core material such as plywood sides having polystyrine foam or the like juxtaposed therebetween. Alternatively, the sidewalls, ceiling, and floor may be fabricated of, for example, molded fiberglass.

Like the modular bathroom system, the modular living system of the present invention may comprise electrical hookups, battery backup, a small generator, solar power, or any number of power supply means already known and practiced in the art. The preferred embodiment of the present invention, configured to be mounted to a tractor/trailer unit, could receive power from the tractor's alternator as primary, and utilize a small generator when the tractor is off. Also, air conditioning/heating may be provided by the tractor, or a conventional roof mounted unit could be implemented.

Further, water and septic and grey water hookups, supplies and/or storage may be implemented, as is known. Also, LP or the like may be provided for heating, kitchen stove and/or oven, and even powering a refrigeration unit, as desired. Under the floor of the modular living unit, a storage area could be provided, which could include a separate LP service compartment, which would be sealed from the inside of the compartment and adjacent storage facility, the LP service compartment ideally having a separate exterior access.

With the advent or cellular telephones, laptop computers, and other miniature electronics and devices, the modular living unit of the present invention, properly equipped, could provide most of the comforts and conveniences of home, allowing the user(s) to work more efficiently, comfortably, and satisfactorily.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A modular bathroom system having a floor, and first and second, and third walls, said first and second walls intersecting to form a corner, said modular bathroom system further comprising:

a lavatory unit having first and second ends, front and rear sides, a top and a bottom, a sink formed in said top of said lavatory unit, said sink having a drain formed therein, said rear side of said lavatory unit generally adjacent to said second wall, pivotal connection means for pivotally supporting said first end of said lavatory unit to said first wall, said pivotal connection means allowing said lavatory unit to be pivoted along said first end of said lavatory, from a first, generally horizontal use position, to a second, generally vertical, storage position, said storage position placing said lavatory unit in general alignment with said first wall;

support means for supporting said lavatory unit in said use position, said support means engaging generally said second end of said lavatory, said support means having formed therein drainage means for removably engaging said drain formed in said sink to a drain conduit in a leak resistant fashion when said lavatory unit is in said use position, and disengaging said drain formed in said sink from said drainage conduit when said lavatory is pivoted from said use position to said storage position.

2. The modular bathroom system of claim 1, wherein there is formed in said front side of said lavatory unit a paper storage compartment wherein there is provided paper storage means for dispensing paper.

3. The modular bathroom system of claim 2, wherein there is further provided a in the vicinity of said second wall, said shower, and wherein said paper storage compartment formed in said lavatory unit is disposed away from said shower.

4. The modular bathroom system of claim 3, wherein there is further provided a toilet situated generally under said lavatory unit, when said lavatory unit is in said use position.

5. The modular bathroom system of claim 4, wherein there is formed in one of said first, second, or third walls a door having first and second side edges, and a bottom, an inside, and an outside, said first side edge having situated therewith a hinge system for hingedly connecting said door to said wall, said second side edge of said door having a latch system associated therewith for latching said door in a closed position, said door further having a splash guard associated with said first and second side edges for preventing the passage of water therethrough.

6. The modular bathroom system of claim 5, wherein there is further included a splash guard associated with the bottom of said door for preventing the passage of water thereunder.

7. The modular bathroom system of claim 6, wherein said splash guard is formed from a lip spaced above said floor.

8. The modular bathroom system of claim 7, wherein said first, second, and third walls are formed from molded fiberglass as a single, unitary structure.

9. The modular bathroom system of claim 8, wherein there is further provided faucet means associated with said sink for providing water to said sink.

10. The modular bathroom system of claim 9, wherein said modular bathroom system is situated within a modular living unit, said modular living unit further comprising a sleeping/living/dining area, and a kitchen area.

11. The modular bathroom system of claim 9, wherein said modular living unit is configured to rest upon and engage the cab of a tractor trailer.

12. The modular bathroom system of claim 11, wherein there is further provided a rollbar passing through two of said first, second, or third walls, and said ceiling, said rollbar having a conduit formed therein wherein there is provided electrical and water lines.

13. The modular bathroom system of claim 9, wherein there is further provided a rollbar passing through two of said first, second, or third walls, and said ceiling, said rollbar having a conduit formed therein wherein there is provided electrical and water lines.

* * * * *